United States Patent [19]

Neil

[11] Patent Number: 4,921,494

[45] Date of Patent: May 1, 1990

[54] ONE-PIECE EARRING CARRIER

[75] Inventor: Vladimir Neil, Rancho Palos Verdes, Calif.

[73] Assignee: Studex Corp.

[21] Appl. No.: 201,697

[22] Filed: Jun. 3, 1988

[51] Int. Cl.[5] ..... A61B 17/34

[52] U.S. Cl. ..... 606/188

[58] Field of Search ..... 128/330, 329 R; 40/301; 63/12; 124/27, 37; 606/185, 188, 117

[56] References Cited

U.S. PATENT DOCUMENTS 4,146,032 3/1979 Rubenstein et al. ..... 128/330

4,527,563 7/1985 Reil ..... 128/329 R

*Primary Examiner*—Michael H. Thaler
*Assistant Examiner*—W. Lewis
*Attorney, Agent, or Firm*—Cislo & Thomas

[57] ABSTRACT

A disposable stud carrier and one-piece earring carrier for holding a clasp for attachment to an earring stud and providing a guide to direct the forward movement of the stud into the clasp. The earring carier is used in conjuction with a stud gun having a protuberance upon its end of which the earring carrier may be positioned upon and so held.

9 Claims, 1 Drawing Sheet

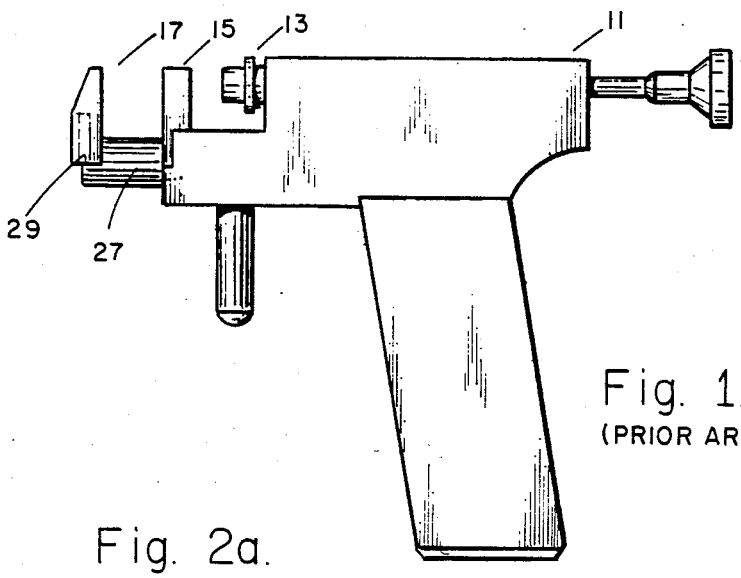
Fig. 1.
(PRIOR ART)
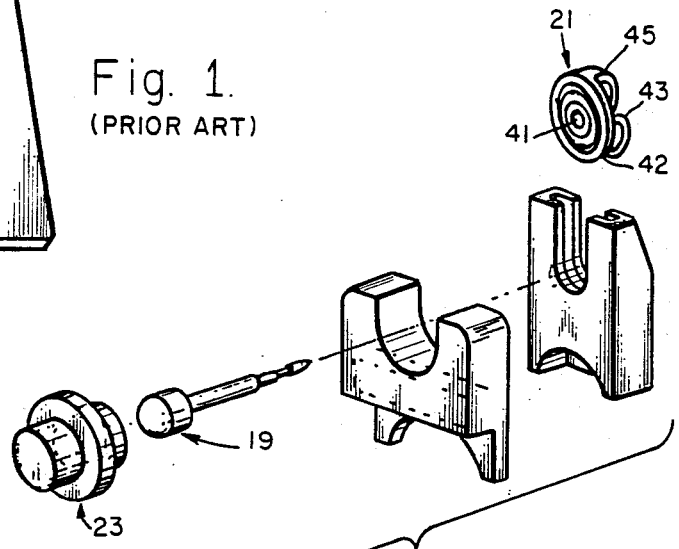
Fig. 2.
(PRIOR ART)
Fig. 2a.
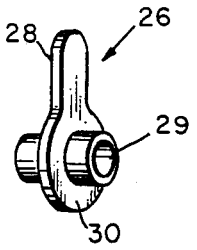
Fig. 3.
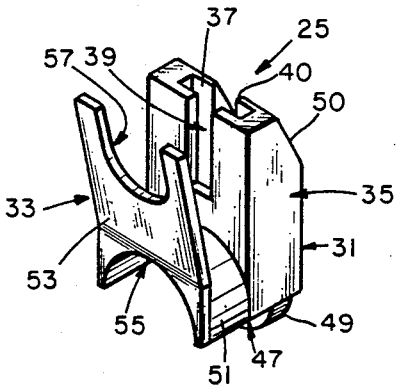
Fig. 4.
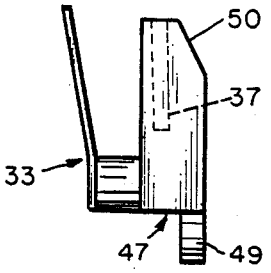
Fig. 5.
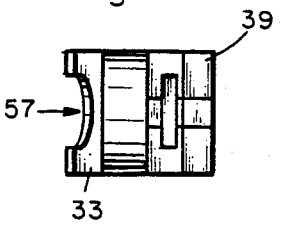
Fig. 6.
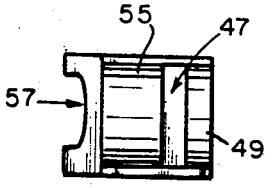
Fig. 7.
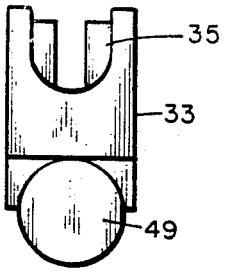
Fig. 8.
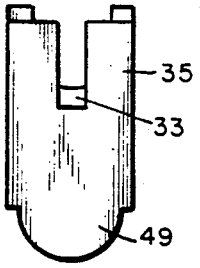

ONE-PIECE EARRING CARRIER

BACKGROUND OF THE INVENTION

The piercing of ears has been accomplished, in the past, with a type of stud gun, as more fully disclosed in U.S. Pat. No. 4, 527,563 issued July 9, 1985. This type of gun can be readily used to pierce ears and simultaneously mount a stud within the hole pierced through the ear and engage a clasp on the portion of the stud extending through the ear.

Most ear piercing is done on the premises of stores which sell earrings for pierced ears. It is critical that a system of ear piercing be sanitary, easy to use, and acceptable in appearance. This is of great importance since the person piercing the ear with a stud gun usually has little or no training in the art of ear piercing. Often times the piercing of ears is done by the salesclerk who also sells the earrings. As disclosed in the above-identified patent, there are many more reasons for having a system of ear piercing which is simple to operate.

However, the system disclosed in the above-identified patent, while of wide spread use, offers some difficulty in its use. In particular, and as shown in FIGS. 1 and 2, a number of pieces must be assembled onto the barrel of the stud gun in addition to the earring stud and clasp to be placed into the purchaser's ear and the clasp to be positioned onto the stud. These individual pieces are a stud holder to hold the stud of the earring, an alignment member to direct the movement of the stud holder and a clasp carrying member to hold the clasp next to the ear while the stud is driven through the ear and into the clasp.

These three components must be assembled before ear piercing can take place. The components are positioned at different places located along the barrel of the stud gun. The positioning of these pieces is critical to the proper operation, and ultimate customer satisfaction, of the ear piercing process.

Because of the number of components and critical nature of positioning those components upon the stud gun, some training on the use of the stud gun is required. Additionally, the possibility of a salesclerk not properly assembling the components upon the stud gun before the ear piercing, can have detrimental consequences for the person having his or her ear pierced. Therefore, there is great interest in the ear piercing industry to develop and sell an improvement to the use of these components in the piercing of ears. The improvement makes the overall ear piercing method easier, faster and with better results while reducing the complexity and criticality of positioning the components. Finally, the improvement makes it easier to manufacture and more economical than the present combination of components.

The features identified above as being desired for assisting in the piercing of ears using a stud gun as mentioned above, are all provided by the present invention.

SUMMARY OF THE INVENTION

The present invention is an improvement to the ear piercing system as disclosed in U.S. Pat. No. 4,527,563, issued July 9, 1985.

More particularly, the invention is a stud carrier and one-piece earring carrier, associated with a barrel portion of a stud gun having an upstanding protuberance upon its end. The earring carrier holds a clasp for attachment to an earring stud and provides a guide to direct the forward movement of the stud into the clasp.

The stud carrier holds the earring stud and has an extending handle and a recess sized to receive the stud to be used.

The earring carrier is an integrally formed member having a clasp carrying portion and an intermediate alignment member so aligned so as to allow the stud to move forward through the alignment member to the clasp portion. The earring carrier is operatively associated with the barrel portion of the stud gun so as to be held by the stud gun. This is achieved because the clasp carrying portion has a recess of a size and configuration to be received by the upstanding protuberance.

The intermediate alignment member is H-shaped and has an underside recess or groove for alignment with the barrel portion of the stud gun and has an upwardly slanted and extended U-shaped upright to direct the forward movement of the stud into the clasp.

The clasp carrying portion also has an upwardly extended tab defining a elongated retaining slot of a size and configuration to carry the clasp therein.

The carrier also has an extending barrel cap which allows the carrier to be hygienically held at a point away from the section that carriers the earring.

The earring carrier can be integrally made of plastic such as polyethylene or any other material which is durable, flexible, and relatively inexpensive.

BRIEF DESCRIPTION OF THE DRAWINGS

FIG. 1 is a side elevational view of the prior art stud gun used in conjunction with this invention showing the prior art earring carrier components;

FIG. 2 is a perspective view of the prior art components as shown in FIG. 1 with the addition of an earring stud, earring clasp and prior art stud holder;

FIG. 2A is a perspective view of the stud carrier of the present invention;

FIG. 3 is a top perspective view of the one-piece carrier of the present invention;

FIG. 4 is an elevational view of the one-piece carrier of the present invention;

FIG. 5 is a top plan view of the one-piece carrier of the present invention;

FIG. 6 is a bottom plan view of the one-piece carrier of the present invention;

FIG. 7 is a front view of the one-piece carrier of the present invention; and FIG. 8 is a rear view of the one-piece carrier of the present invention.

DESCRIPTION OF THE PREFERRED EMBODIMENT

The present invention may be used with a stud gun 11 of the type shown in FIG. 1. The gu is also used with the present invention to pierce the ear and place an earring stud 19 through an ear into an earring clasp 21, as illustrated in FIG. 2. Particularly, the stud 19 is held in a stud carrier 23 which can be driven toward the clasp 21.

The present invention is a disposable integrally formed, one-piece carrier 25 with a handled stud carrier 26. As shown in FIG. 2A, the carrier 26 has a handle 28 which can be easily held between two fingers. A recess 29 is formed in the carrier 26 to hold the earring stud 19 prior to insertion. Also, the stud carrier 26 has a flange 30 radially extending around the recess 29. The earring stud 19 can be packaged within the stud carrier 26.

As shown in FIGS. 2A–8 inclusive, the earring carrier 25 is of a design so as to be associated with a barrel portion 27 of the stud gun 11 shown in FIG. 1. The gun has a protuberance 29 shown in phantom and upon its end which the carrier 25 engages, as will be seen. The earring carrier 25 not only holds the clasp 21 which receives the stud 19 upon piercing, but the carrier 25 also guides and directs the forward movement of the stud 19 into the clasp 21.

The carrier 25 has a clasp carrying portion 31 and an intermediate alignment member 33 so aligned as to allow the stud 19 within the stud carrier 26 to move forward through the alignment member 3 to the clasp portion 31.

The clasp carrying portion has an upstanding tab 35 defining a slot or recess 37 therein to hold the clasp 21 perpendicular to the movement of the stud 19. The slot 37 can be made more accessible by exposed sides 39 and 40, so as to make placing the clasp within the invention easier. The exposed sides are also critical to leaving the stud engaged with the clasp within the ear after piercing. The exposed sides let the clasp 21 and stud 19 slide out of the carrier 25 after piercing occurs.

The dimensions of the slot 37 within the tab 35 are such that the earring clasp 21 or backing may be slid into the slot. Circular edges 42 of the earring clasp 21 are held within the slot 37 while allowing a center aperture 41 of the earring clasp to be exposed. The clasp 21 is held such that the stud 19 may be driven into the exposed aperture 41 of the earring clasp. Furthermore the tab 35 is of a configuration to allow curved ends 43 and 45 of the clasp 21 to be exposed such that the clasp 21 can be easily grabbed with the fingers and removed from the earring carrier 25.

The underside of the upstanding tab 31 further defines another slot 47 (shown in phantom in FIG. 4) and has a complementary shape to the upstanding protuberance 29 on the barrel 27 of the stud gun 11 so as to engaged the protuberance before and during ear piercing. A barrel cap 49 secures the position and fit of the invention to the end of the barrel 27 of the stud gun 11. The barrel cap 49 offers stability because of the friction fit between the invention and the protuberance. Additionally, the barrel cap 49 provides a way to hygienically hold the carrier 25 and not touch portions of the carrier exposed to the pierced ear.

The upstanding tab 31 has a chamfered edge 50 on its end which allows greater ease in placing the earring clasp 21 into the slot 37. The chamfered edge 50 better exposes the curved ends 43 and 45 of the earring clasp 21 so that one's fingers may hold the ends and push the clasp into the slot 37.

A curved extension 51 joins the upstanding tab 35 to the intermediate alignment member 33. The curved extension 51 is of a semi-circular shape such as to complement the curved surface of the barrel 27 of the stud gun The curved extension 51 allows the carrier 25 to rest upon the top of the barrel 27 of the stud gun 11 and align the intermediate alignment member 33 with the clasp carrying portion 31.

The intermediate alignment member 33 having an H-shaped has a U-shaped upstanding tab 53. The H-shape is formed by two semi-circular cutouts 55 and 57 opposite each other. The lower semi-circular cutout 55 from the tab, like the curved extension 51 allows the carrier 25 to rest upon the barrel 27 of the stud gun 11. The upper semi-circular cutout 57 allows the stud carrier 26 and stud 19 to move through the intermediate alignment member 33, yet direct the travel of the stud carrier 26 and stud 19 so that the stud enters the aperture 41 of the clasp 21. The dimensions of the upper semi-circular cutout are of a size such that the stud carrier 26 cannot pass by the intermediate alignment member 33 when driving the stud 19 into the clasp 21. Rather, the intermediate alignment member 33 flexes when receiving the stud carrier 26. The flange 30 of the stud carrier 26 is of a larger diameter than can pass through the upper semi-circular cutout 57.

The U-shaped tab 53 is slightly slanted away from the vertical plane, that is, away from the clasp carrying portion 31. The tab's slant allows greater resistance to the stud carrier 26 allowing the tab to flex so as to direct the forward movement of the stud carrier 26 and stud 19. This insures that the stud always engages the aperture 41 of the clasp 21 .

The carrier 25 and stud carrier 26 are formed of a plastic material, preferably one which allows flexing. Polyethylene is one plastic that may work. However, the stud carrier 26 can be made of a stiffer material. Both elements of the present invention can be molded as a single component.

It should be appreciated from the foregoing description that the present invention provides an improved one-piece earring carrier which is simple in construction, simple to use, yet completely effective in holding an earring stud and clasp and properly directing an earring stud into the clasp upon insertion. The invention is easy to manufacture, convenient to package and eliminates the need for exact precision in positioning itself along the barrel portion of the stud gun.

Although the present invention has been described in detail with reference only to the presently preferred embodiment, it will be appreciated by those of ordinary skill in the art that various modifications can be made without departing from the invention. Accordingly, the invention is limited only by the following claims.

I claim:

1. A one-piece disposable earring component carrier for association with the barrel portion of a stud gun having an upstanding protuberance upon its end for holding an earring clasp for attachment to an earring stud and guide the forward movement of the stud into the clasp comprising:

an unitary member having a clasp carrying portion, an alignment portion, a tab portion, and a barrel cap portion, wherein said clasp carrying portion includes a inferiorly positioned slot to quickly associate or dissociate said unitary member from the upstanding protuberance of the stud gun, said clasp portion including a superiorly positioned slot to receive the earring clasp, and wherein said alignment portion is positioned between said tab portion and said clasp carrying portion, said alignment portion includes a curved undersurface for alignment and engagement to the barrel portion of the stud gun, and wherein said tab portion is flexible and aligned with said clasp carrying portion to allow the stud holder to engage and flex said tab portion when the stud holder is moved toward said clasp carrying portion, and wherein said barrel cap portion extends below said clasp carrying portion to engage the barrel end of the stud gum and provides means to hygienically hold the unitary member.

2. A one-piece disposable earring carrier as claimed in claim 1, wherein said inferiorly positioned slot is of a size and configuration to be received by the upstanding protuberance and wherein said superiorly positioned slot of said clasp carrying portion is of a size and configuration to receive the clasp therein.

3. A one-piece disposable earring carrier as claimed in claim 2, wherein said tab portion extends a predetermined amount away from said clasp carrying portion.

4. A one-piece disposable earring carrier as claimed in claim 3, wherein said unitary member is integrally formed of plastic.

5. A combination of a stud carrier and one-piece disposable earring component carrier for association with the barrel portion of a stud gun having an upstanding protuberance upon its end, for holding an earring clasp for attachment to an earring stud and providing a guide to direct the forward movement of the stud into the clasp comprising:

a stud holder including a recess sized to receive the earring stud for attachment, having an extending handle, and having a flange located about said recess;

a unitary member having a clasp carrying portion for retaining and holding the clasp, a tab portion and an alignment portion, which includes a means to quickly associate or dissociate said unitary retaining member from the upstanding protuberance of the stud gun, wherein said alignment portion is positioned between said tab portion and said clasp carrying portion and includes a curved undersurface for alignment and engagement with the barrel portion of the stud gun, and wherein said tab portion is aligned with said clasp carrying portion to allow said stud holder to engage said tab portion when said stud holder is moved toward said clasp carrying portion.

6. A combination of a stud carrier and one-piece disposable earring carrier as claimed in claim 5, wherein said clasp carrying portion has a superiorly positioned recess of a size and configuration to receive the earring clasp and wherein said retaining means of said clasp carrying portion includes an inferiorly positioned slot of a size and configuration to receive and engage the upstanding protuberance of the stud gun.

7. A combination of a stud carrier and one-piece disposable earring carrier as claimed in claim 6, wherein said tab portion is flexible and extends a predetermined amount away from the clasp carrying portion, and flexes when engaged by said stud holder prior to the stud engaging the clasp.

8. A combination of a stud carrier and one-piece disposable earring carrier as claimed in claim 7, wherein each of said stud holder and said unitary member are formed of plastic.

9. A one-piece disposable earring carrier as claimed in claim 8, further comprising a barrel cap portion which extends below the clasp carrying portion to engage the barrel end of the stud gun and securely holds said unitary member upon the barrel of the stud gun and provides means to hygienically hold the carrier.

* * * * *